US010501899B2

(12) United States Patent
Braun

(10) Patent No.: US 10,501,899 B2
(45) Date of Patent: Dec. 10, 2019

(54) STRUCTURAL BEARING

(71) Applicant: Maurer Engineering GmbH, Munich (DE)

(72) Inventor: Christian Braun, Holzkirchen (DE)

(73) Assignee: MAURER ENGINEERING GMBH, München (DE)

( * ) Notice: Subject to any disclaimer, the term of this patent is extended or adjusted under 35 U.S.C. 154(b) by 0 days.

(21) Appl. No.: 15/773,429

(22) PCT Filed: Nov. 4, 2016

(86) PCT No.: PCT/EP2016/076702
§ 371 (c)(1),
(2) Date: May 3, 2018

(87) PCT Pub. No.: WO2017/077057
PCT Pub. Date: May 11, 2017

(65) Prior Publication Data

US 2018/0320325 A1 Nov. 8, 2018

(30) Foreign Application Priority Data

Nov. 6, 2015 (DE) ..... 10 2015 221 864

(51) Int. Cl.
*E01D 19/04* (2006.01)
*E04H 9/02* (2006.01)
*E04B 1/36* (2006.01)

(52) U.S. Cl.
CPC ..... *E01D 19/041* (2013.01); *E01D 19/04* (2013.01); *E04B 1/36* (2013.01); *E04H 9/021* (2013.01)

(58) Field of Classification Search
CPC ..... E01D 19/041; E01D 19/04; E04B 1/36; E04H 9/021
USPC ..... 52/167.7
See application file for complete search history.

(56) References Cited

U.S. PATENT DOCUMENTS 3,606,715 A * 9/1971 Wyss et al. ..... B65D 90/12 52/294
4,063,394 A * 12/1977 Feuerlein ..... B65D 90/12 52/294
4,320,549 A * 3/1982 Greb ..... E01D 19/046 14/73.5
4,928,339 A * 5/1990 Klawe ..... E01D 19/047 14/73.5
5,605,021 A * 2/1997 Thomann ..... B63B 1/041 52/167.1
5,797,228 A * 8/1998 Kemeny ..... E04H 9/022 248/632
6,688,051 B2 * 2/2004 Tsai ..... E01D 19/04 248/636

(Continued)

FOREIGN PATENT DOCUMENTS

WO 2006/042566 A1 4/2006
WO 2014/173622 A1 10/2014

*Primary Examiner* — Patrick J Maestri
*Assistant Examiner* — Joseph J. Sadlon
(74) *Attorney, Agent, or Firm* — Baker & Hostetler LLP

(57) ABSTRACT

A structural bearing is provided having at least one sliding element made of a sliding material that contains at least one polymeric plastic, wherein the siding material has a melting point temperature of more than 210° C. and a modulus of elasticity in tension according to DIN ISO 527-2 of less than 1800 MPa.

17 Claims, 1 Drawing Sheet

(56) References Cited

U.S. PATENT DOCUMENTS

| | | | | |
|---|---|---|---|---|
| 7,547,142 | B2 * | 6/2009 | Robinson | E01D 19/04 248/560 |
| 7,707,788 | B2 * | 5/2010 | Bystricky | E04H 9/021 52/167.1 |
| 7,793,471 | B2 * | 9/2010 | Hill | B32B 3/10 428/33 |
| 8,011,142 | B2 * | 9/2011 | Marioni | E04H 9/023 248/560 |
| 8,696,205 | B2 * | 4/2014 | Tavecchio | E01D 19/04 384/36 |
| 8,973,887 | B2 * | 3/2015 | Nakata | F16C 23/045 248/562 |
| 9,175,468 | B1 * | 11/2015 | Tsai | E04B 1/36 |
| 9,435,087 | B2 * | 9/2016 | Kim | F16C 13/04 |
| 9,540,780 | B2 * | 1/2017 | Urich | E01D 19/047 |
| 2009/0188179 | A1 * | 7/2009 | Huber | E04H 9/023 52/167.7 |
| 2013/0000226 | A1 * | 1/2013 | Sugita | E04H 9/021 52/167.7 |
| 2014/0026498 | A1 * | 1/2014 | Quaglini | E01D 19/046 52/167.4 |

* cited by examiner

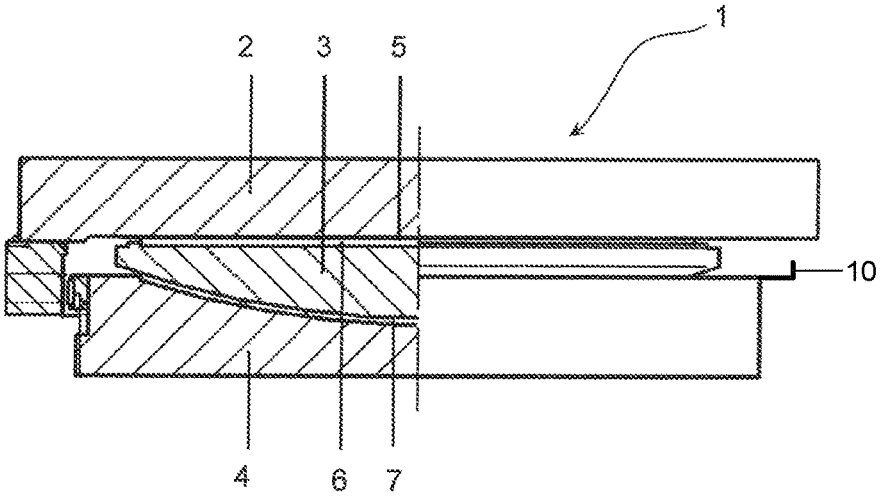
1
2
3
5
10
4
6
7

STRUCTURAL BEARING

CROSS-REFERENCE TO RELATED APPLICATIONS

This application is a National Stage of International patent application PCT/EP2016/076702, filed on Nov. 4, 2016, which claims priority to foreign German patent application No. DE 10 2015 221 864.3, filed on Nov. 6, 2015, the disclosures of which are incorporated by reference in their entirety.

FIELD OF THE INVENTION

The present invention relates to a structural bearing having a sliding element made of a sliding material containing at least one polymeric plastic.

BACKGROUND

Here, a structural bearing is meant to be such bearings that generally are provided in buildings to bear the building or parts thereof. Especially, these are bearings falling within the rules of the European Norm EN 1337. That is, they can be components that allow rotations between two building parts and transmit loads defined in the relevant requirements and prevent displacements (fixed bearings) or allow displacements in one direction (guided bearings) or in all directions of a plane (free bearings).

The most common structural bearings are set forth in part 1 of EN 1337 in its currently valid version from 2004 (EN 1337-1:2004) in table 1. However, further designs and variations can be found in other norms. So, in EN 15129 specifically bearings for earthquake isolation are standardized. Here, the present invention particularly relates also to sliding bearings of different shapes such as for example spherical sliding bearings or the sliding isolation pendulum bearings etc. mentioned in EN 15129 and used there for earthquake isolation.

Here, a sliding element is meant to be such parts of a structural bearing that ensure and allow, respectively, a sliding movement between the parts of the structural bearing. Especially, these are parts falling within the rules of part 2 of EN 1337 in the version from 2004 (EN 1337-2:2004).

However, unlike determined in EN 1337-2:2004 the invention not only concerns structural bearings having a sliding element made of a polytetrafluoroethylene (PTFE, trade name Teflon), but generally also other polymeric plastics, in particular thermoplastics such as for example ultrahigh molecular weight polyethylene (UHMWPE), polyamide (PA), and mixtures thereof.

Basically, the demands on the polymeric plastics used as sliding material are known. On the one hand, they should allow an even distribution and transmission of the load acting on the structural bearing. On the other hand, they have to absorb sliding movements in the structural bearing (translatory and/or rotatory movements) such that—at least in the state of use—the building is not damaged. As far as that goes, the sliding movements can be realized with application-specified demands on the friction coefficient. For example, EN 1337-2:2004 defines such demands on the friction coefficient, however only for sliding parts made of PTFE. In EN 15129, in particular in section 8.3, in turn there are defined general test set-ups for the determination of friction for dissipation during an earthquake, that is such that apply for so-called seismic bearings. Further, of course such a sliding material should be resistant to environmental influences such as for example temperature, moisture, but also aggressive media such as acid rain or air pollution and have the greatest possible resistance to wear.

Experience has shown that polymeric plastics have differently pronounced properties, so that they can be selected in view of the use in such a structural bearing only by entering into various compromises between the corresponding requirements profiles.

A particularly good compromise of a particularly load-bearing, wear-resistant sliding material that is also resistant to environmental influences the applicant obtained with its MSM® sliding material. This is used in the form of sliding elements that are formed as flat and/or curved sliding discs, but also as guides. Particularly successful is the use in the field of sliding bearings, for example in so-called spherical sliding bearings, but also for seismic isolation in sliding isolation pendulum bearings. Here, the MSM sliding material has virtually led to a revolution in the construction of structural bearings, since it has led to a significantly longer durability of the bearings at lower manufacturing costs.

However, despite these excellent properties it has been shown that these already very widespread structural bearings in certain fields of application, especially in hot regions, reach the limit of their capacity. This is because in the polymeric plastics that are so far common in the construction of structural bearings (such as for example PTFE, UHMWPE) just the compression stability at higher temperatures decreases and the friction number or friction coefficient, respectively, change with an increasing temperature. As far as that goes, the energy dissipation in case of an unlubricated use under certain circumstances is not satisfactory. Moreover, the bearings with the known sliding materials in general have large dimensions, if the bearings should have a defined degree of friction to dissipate energy.

SUMMARY OF THE INVENTION

Thus, the object of the present invention is to provide a structural bearing that is suitable for use at higher temperatures and/or contact pressures and at the same time has a defined friction behavior without being larger in size as compared to conventional structural bearings.

The solution of this problem is obtained with the structural bearing according to claim 1. Advantageous developments of the invention are given in the dependent claims.

Now, the solution approach according to the invention is that the sliding material of the sliding element has a melting point temperature of more than 210° C. and a modulus of elasticity in tension in accordance with DIN ISO 527-2 of less than 1800 MPa. Here, the interaction of these two criteria makes particularly critical demands on the properties of the sliding material. In general quite late melting materials, such as for example polyamide, are stiffer than materials with a low melting point.

This is based on the finding that, to ensure a high load bearing capacity also at high temperatures, it is necessary that the polymeric plastic not only has a melting point temperature that is as high as possible, but at the same time must not be too stiff. The stiff thermoplastics so far typically used at increased temperatures exhibit an unsatisfactory load transmission behavior. So, manufacturing tolerances or building settlements are only difficult to compensate by the sliding material or sliding element in the bearing, what then easily results in an increased wear of the accordingly higher loaded areas of the sliding elements in the structural bearing.

However, if both criteria are fulfilled—as experiments of the applicant prove—it can be assumed that also at higher temperatures there is still present a defined friction behavior without having to make the structural bearing larger than a conventional bearing. Moreover, the bearings according to the invention have a significantly increased durability.

Also, the so-called stick-slip phenomenon is reduced. This is meant to be a jerking sliding movement, as is known for example from wiper blades in cars. Experiments of the applicant demonstrate that sliding elements made of a sliding material that fulfills such a property profile still have only relatively slight differences between static and dynamic friction numbers. In this way, the stick-slip phenomenon is reduced. Especially, if the structural bearing also is for seismic protection this improves the safety of the whole building.

In a further development the structural bearing has a sliding element made of a sliding material that has a characteristic compressive strength of at least 250 MPa at 48° C. and/or at least 220 MPa at 70° C. and/or at least 200 MPa at 80° C. Here, the value of the characteristic compressive strength can be determined in a contact pressure experiment on a specimen that corresponds to specific dimension demands and consists of the sliding material.

A suitable contact pressure test with dimension demands and the conditions under which it is to be performed is given in the European Technical Approval ETA 06/0131 and its approval guideline, for example. Accordingly, a suitable contact pressure test is meant to be a test in which a partially embedded sample in the form of a flat circular disc having a diameter of 155 mm, a thickness of 8 mm and an embedding depth of 5 mm is loaded with the desired temperature and contact pressure (further information on shape, embedding, and load of the specimen are given in ETA 06/0131 and its approval guideline). Here, the comparative temperature may be a typical temperature of 35° C., for example. The settlement operation due to the contact pressure has to stop after a given time (generally 48 hours). After release the sample is examined for damages (e.g. cracks).

Here, characteristic compressive strength is meant to be that used in EN 1337-2:2004. This is the maximum contact pressure at which the settlement stops as mentioned and just yet no damages occur. In general, thus the maximum absorbable contact pressure and thus, the characteristic compressive strength iteratively is determined by several of such tests.

The demand for a relatively high characteristic compressive strength together with a high melting point temperature and the relatively low modulus of elasticity as well leads to the fact that it is ensured that the correspondingly used polymeric plastic in the unlubricated state has a defined not necessarily low friction number or friction coefficient, respectively. This defined friction can be used to dissipate kinetic energy in energy-dissipating bearings. At the same time, due to the requirement profile it is also ensured that the material has a high load bearing capacity at high temperatures to be able to absorb as much energy as possible. Moreover, the tests of the applicant show that a very little pronounced stick-slip phenomenon arises as well and in total there results an easily responding bearing. That is, the structural bearing according to the invention is characterized in a combination of efficiency and the prevention of building damaging vibrations of a high frequency and low amplitude.

In a further development the unlubricated sliding material in a short-time sliding friction test in analogy to EN 1337-2:2004 supplement D has a maximum friction coefficient at 21° C. and a contact pressure of 60 MPa of at least 0.05. Since it is a test on an unlubricated material the sliding disc in modification to the conventional test according to EN1337-2:2004 here has no lubrication bore reliefs. The limit of the friction coefficient ensures that there is a defined friction number, especially in the unlubricated state, which is for dissipating kinetic energy.

In a further development the sliding material has a ratio of static friction coefficient to dynamic friction coefficient of less than 1.4. This ensures that virtually no stick-slip phenomenon results.

It is also suitable if the sliding material has a yield strength of more than 15%, preferably of up to 30%. This enables the sliding element to totally elastically adapt to an eccentrically occurring deformation. Also, such a sliding element hardly shows torus formation, which reduces the risk of shearing-off such a torus. This results in the fact that such a structural bearing has a greater intrinsic rotational capacity than a conventional structural bearing. This is of advantage especially with flat sliding bearings since this way they are able to better compensate tilts of the building (e.g. due to the settlements of the building or of manufacturing tolerances).

In a further development the sliding material contains polyketone as the polymeric plastic. Among others, polyketone is prepared from carbon monoxide and is said to be an environmentally acceptable plastic, because, in processing, carbon monoxide from industrial off-gas can be used, for example. Polyketone has turned out to be a material that combines a high melting point with a relatively high friction compared to UHMWPE or PTFE. But just at high temperatures the friction coefficients remain relatively constant, while in other known materials in general they show a strong temperature dependency.

At the same time, polyketone is a polymeric plastic that has a relatively low modulus of elasticity. A sliding element consisting thereof shows a good adaptability and a good ability to compensate manufacturing tolerances or building settlements. And this also if the bearing is used at high temperatures without the material deforming excessively. Moreover, tests on polyketone show that the sliding material has a considerably low ratio of static friction coefficient to dynamic friction coefficient, so that also in view of the stick-slip problem it can be classified as particularly suitable.

As far as that goes this material that certainly has been known for a long time now has come into focus of this field of application for the first time based on the tests of the applicant. Just the tests of the applicant prove that certainly it does not have an excellent individual property, but a particularly considerable overall property profile over its various individual properties. Just the combination of properties such as the high melting point, the low modulus of elasticity, the favorable ratio of static friction coefficient to dynamic friction coefficient at a friction that is certainly higher but also at high temperatures is relatively stable makes it seem an almost ideal material for the manufacture of structural bearings, especially energy-dissipating bearings.

Also, the sliding material can be vulcanized onto an elastomer (such as for example a rubber), for example to form a sliding element for an elastomeric sliding bearing.

In a further development the sliding material contains a polyamide having a water saturation of at least 5%, preferably more than 7%, as the polymeric plastic. Tests of the applicant show that with water-saturated polyamide the modulus of elasticity of ca. 3000 MPa can be reduced to less than 700 MPa. That is, if the appropriate water saturation is ensured also polyamides fulfill the above-mentioned property profile. That is, the polyamides that have hitherto been regarded as too stiff according to the invention can be employed very well. It has just to be ensured that they have an appropriate water saturation of at least 5%, preferably more than 7%. Then, it is also possible to reduce or appropriately control stick-slip phenomena that just with polyamides are particularly pronounced.

In a further development a water supply for ensuring a permanent water saturation of the sliding material is assigned to the sliding element. Here, a water supply is meant to be a facility of a very general type that supplies water to the sliding element and thus, the sliding material. For example, this could be sprinkler systems, but also water-holding basins in which the sliding element is disposed. Here, a water-holding basin 10 again very generally is meant to be a facility that is capable to prevent water from flowing away. For example, this could be storm-water that is retained or also water that is filled into the basin 10 and is prevented from flowing away at least for a longer time. It is only important that it is ensured that the sliding element is in contact with water for as long as possible.

It would also be suitable if the sliding element at least partially is surrounded by a water vapor-holding casing. For example, this could be an appropriate film that wraps the sliding element such that no water or only little water vapor escapes. Here, in case of doubt the casing will only be disposed at the sides of the sliding element that do not belong to the contact surface of the sliding element with its sliding counterpart such as for example a sliding plate.

Particularly preferably, the structural bearing according to the invention is configured as an energy-dissipating bearing, preferably as a sliding isolation pendulum bearing (due to the defined friction this could also be referred to as a friction pendulum bearing). Especially, here it is not so much a matter of a particularly low friction, but rather a particularly constant friction also at high temperatures. Just the latter occur in case of earthquakes due to the high accelerations.

It could also be suitable if the structural bearing according to the invention is configured as an elastomeric sliding bearing. Just when the sliding element has a polyketone as the sliding material this can be vulcanized onto an elastomer in a particularly simple manner.

In a further development the sliding material in addition to the at least one polymeric plastic still contains at least one further polymeric plastic, especially a UHMWPE or PTFE or PA, at least one filler and/or an additive. Here, a filler is meant to be substances that just are not a polymeric plastic. An additive is meant to be such blends that still further influence the properties of the plastic in a certain manner, such as for example included solid lubricants.

In a further development the sliding material also additionally could have been cross-linked by means of radiation and/or chemical treatment. So, by cross-linking additional specific properties can be added or enhanced, respectively. For example, tests of the applicant have shown that by cross-linking for example the edge zones of a sliding disc it is possible to influence it in such a way that its wear resistance is improved without negatively influencing the global friction coefficients of the sliding disc.

In a further development the sliding element is configured as a flat and/or curved sliding disc. Finally, the structural bearing can also be further developed such that the sliding disc is configured in segments and has at least two sub-segments. So, by segmenting the sliding disc in addition friction properties and energy-dissipating properties can selectively be adjusted and influenced.

This selective adjustment of the friction properties is particularly successful if the sliding disc is configured from a plurality of sub-segments that in turn are preferably configured round and have a diameter of 20 to 50 mm. So, the friction coefficient of each individual sub-segment can be determined experimentally. By the selective arrangement of a plurality of such sub-segments then the desired overall property profile can be set cumulatively. Also, a subsequent adjustment of the overall friction coefficient, for example by removing or adding individual sub-segments, is possible. Moreover, especially with a high compressive strength of the sliding material great surface contact pressures and thus, small bearing surfaces of the bearing are possible. Thereby, in comparison to a large single sliding disc the risk of high eccentric contact pressures can be reduced almost arbitrarily.

Here, it could be useful if individual sub-segments of the sliding disc consist of another sliding material, preferably a polyamide, a PTFE and/or a UHMWPE. So, by an intelligent material mix individual positive properties of individual sub-segments in the bearing can even more selectively be used and the overall properties even better be adjusted.

BRIEF DESCRIPTION OF THE DRAWINGS

In the following the invention is explained in detail by way of an example. Here:

FIG. 1 schematically shows a partial section through a structural bearing according to the invention with a disc-shaped sliding element.

DETAILED DESCRIPTION

The structural bearing 1 shown in FIG. 1 in a partially sectioned illustration (left part of the illustration) is a sliding bearing that is configured as a so-called spherical sliding bearing of a basically known design. Here, this is shown only to illustrate what a structural bearing is basically meant to be. However, with respect to the present invention the design of the bearing is not important. That is, it could also be an arbitrarily differently designed structural bearing with a sliding element 6 according to the invention.

The structural bearing 1 shown in FIG. 1 has an upper plate 2, a spherical cap 3, a lower plate 4, a sliding plate 5, and a sliding element 6 in a sliding contact with the sliding plate 5 in the form of a flat sliding disc made of polymeric plastic. Moreover, the bearing has a second curved sliding element 7. This is in sliding contact with the curved surface of the spherical cap 3.

The structural bearing 1 shown here is such one in which according to the invention a sliding material for the sliding elements 6 and 7 is used that has a melting point temperature of more than 210° C. and a modulus of elasticity in tension according to DIN ISO 527-2 of less than 1800 MPa.

In the present case the sliding material consists of a polyketone and also at high temperatures has relatively high values of characteristic compressive strength of ca. 250 MPa at 48° C., ca. 220 MPa at 70° C. and ca. 200 MPa at 80° C.

Moreover, the sliding material has a relatively high yield strength of up to 30%. This enables the sliding element to elastically adapt to an eccentrically occurring deformation. Just with a flat sliding bearing (as the one shown here) this is particularly advantageous since this way it can better compensate tilts of the building (e.g. due to settlements of the building or manufacturing tolerances).

The invention claimed is:

1. A structural bearing having at least one sliding element made of a sliding material that contains at least one polymeric plastic, wherein the sliding material has a melting point temperature of more than 210° C. and a modulus of elasticity in tension according to DIN ISO 527-2:2012 of less than 1800 MPa, wherein the sliding material further has a characteristic compressive strength of at least 250 MPa at 48° C. and/or at least 220 MPa at 70° C. and/or at least 200 MPa at 80° C. and wherein the sliding material contains a polyketone as the polymeric plastic.

2. The structural bearing according to claim 1, wherein the unlubricated sliding material in a short-time sliding friction test pursuant to EN 1337-2:2004 supplement D has a maximum friction coefficient at 21° C. and a contact pressure of 60 MPa of at least 0.05.

3. The structural bearing according to claim 1, wherein the sliding material has a ratio of static friction coefficient to dynamic friction coefficient ($\mu_s/\mu_{dyn}$) that is smaller than 1.4.

4. The structural bearing according to claim 1, wherein the sliding material has a yield strength of more than 15%.

5. The structural bearing according to claim 1, wherein the sliding material is vulcanized onto an elastomer.

6. The structural bearing according to claim 1, wherein the sliding material contains a polyamide having a water saturation of at least 5%, as the polymeric plastic.

7. The structural bearing according to claim 1, wherein a water supply for ensuring a permanent water saturation of the sliding material is assigned to the sliding element.

8. The structural bearing according to claim 1, wherein the sliding element is disposed in a water-holding basin.

9. The structural bearing according to claim 1, wherein the sliding element at least partially is surrounded by a water vapor-holding casing.

10. The structural bearing according to claim 1, wherein the sliding material in addition to the at least one polymeric plastic contains at least one further polymeric plastic and/or at least one filler or an additive.

11. The structural bearing according to claim 1, wherein the sliding material has been cross-linked by means of radiation and/or chemical treatment.

12. The structural bearing according to claim 1, wherein it is configured as an energy-dissipating friction pendulum bearing.

13. The structural bearing according to claim 1, wherein it is configured as an elastomeric sliding bearing.

14. The structural bearing according to claim 13, wherein individual sub-segments of the sliding disc comprise another sliding material of a polyamide, a PTFE and/or a UHMWPE.

15. The structural bearing according to claim 1, wherein the sliding element is configured as a flat sliding disc and/or curved sliding disc.

16. The structural bearing according to claim 15, wherein the sliding disc is configured in segments and has at least two sub-segments.

17. The structural bearing according to claim 16, wherein the sliding disc is configured from a plurality of sub-segments that are preferably round and have a diameter of 20 to 50 mm.

* * * * *